US006044807A

United States Patent [19]

Hata

[11] Patent Number: 6,044,807

[45] **Date of Patent: *Apr. 4, 2000**

[54] REVERSE ROTATION CONTROL APPARATUS FOR A TWO-CYCLE ENGINE OF A MOTOR VEHICLE

[75] Inventor: Toshiaki Hata, Kobe, Japan

[73] Assignee: Mitsubishi Denki Kabushiki Kaisha, Tokyo, Japan

[ * ] Notice: This patent is subject to a terminal disclaimer.

[21] Appl. No.: 09/083,240

[22] Filed: May 22, 1998

[30] Foreign Application Priority Data

Feb. 2, 1998 [JP] Japan ..... 10-020898

[51] Int. Cl.[7] ..... F01L 13/02

[52] U.S. Cl. ..... 123/41 E; 123/41 R

[58] Field of Search ..... 123/41 E, 41 R, 123/406.14

[56] References Cited

U.S. PATENT DOCUMENTS 5,036,802 8/1991 D'Amours .
5,782,210 7/1998 Venturoli et al. ..... 123/41 E
5,794,574 8/1998 Bostelmann et al. ..... 123/41 E

*Primary Examiner*—Noah P. Kamen
*Assistant Examiner*—Hai Huynh
*Attorney, Agent, or Firm*—Sughrue, Mion, Zinn, Macpeak & Seas, PLLC

[57] ABSTRACT

A reverse rotation control apparatus for a two-cycle engine of a motor vehicle which can be implemented inexpensively while preventing exhaust gas composition and ignition performance from degradation. The apparatus includes a variety of sensors for generating a variety of information signals corresponding to engine operating states, and an ignition control unit (10A) for generating an ignition signal (P) for the engine (1) on the basis of the variety of information. The sensors include at least a rotation sensor (6) for generating a rotation signal (SG) and a reverse rotation switch (23) for generating a reverse rotation command signal (RW). The ignition control unit (10A) includes an ignition timing retard control means for causing an ignition timing of the engine (1) to retard beyond a top dead center (TDC) upon inputting of the reverse rotation command signal (RW), an engine rotation number decision means for deciding whether or not a rotation number (Re) of the engine (1) is lowered to a predetermined rotation number (ReW) suited for the reverse rotation control, and an excessively advanced ignition signal generating means for outputting only once an ignition signal (P) advanced excessively relative to a normal advanced ignition timing when the engine rotation number (Re) is lowered to the predetermined rotation number (ReW) suited for the reverse rotation control.

7 Claims, 4 Drawing Sheets

REVERSE ROTATION CONTROL APPARATUS FOR A TWO-CYCLE ENGINE OF A MOTOR VEHICLE

BACKGROUND OF THE INVENTION

1. Field of the Invention

The present invention generally relates to a reverse rotation control apparatus for a two-cycle engine which makes it possible to drive or run a motor vehicle equipped with the two-cycle engine exchangeably in forward or rearward (backward) direction by reversing rotation of the engine. More specifically, the present invention is concerned with a reverse rotation control apparatus for a two-cycle engine mounted on a motor vehicle which apparatus can realize a reverse rotation control processing with inexpensive hardware structure without incurring degradation in the exhaust gas composition and the ignition performance of the motor vehicle equipped with the two-cycle engine.

2. Description of Related Art

In general, a four-cycle engine mounted on a motor vehicle such as a passenger car or the like is equipped with a clutch and a gear box at an output side of the engine for deriving the output power thereof through the medium of the clutch and the gear box.

However, in the case of small-size motor vehicles for specific purposes such as snowmobiles, all-terrain vehicles and the like, a two-cycle engine of an inexpensive structure is mounted. In this conjunction, it is further noted that in case of these motor vehicles, the space for installing or accommodating the engine is limited.

Such being the circumstances, no gear box is ordinarily installed as the reverse rotation control apparatus for the two-cycle engine in these types of the motor vehicles, wherein the output torque of the engine is derived by way of a centrifugal-type automatic transmission implemented in the form of a V-belt transmission.

Consequently, the motor vehicle can be driven only in the forward direction. Thus, manpower is required for moving the motor vehicle backwards or rearwards as is in the case where the motor vehicle is to be taken out from a garage or it is to be disburden from a carrier such as a lorry, giving rise to a problem that the motor vehicle is very inconvenient to handle.

For evading the problem mentioned above, it has been proposed that a clutch and a gear box are provided equally for the motor vehicle equipped with the two-cycle engine by affording a sufficient space for installation of the two-cycle engine so that the traveling direction of the motor vehicle can be changed over between the forward direction and the backward or rearward direction by manipulating a gear change lever, as in the case of the four-cycle engine.

For having a better understanding of the concept underlying the present invention, a hitherto-known or conventional reverse rotation control apparatus for a two-cycle engine of a motor vehicle will be reviewed in some detail.

FIG. 4 is a block diagram showing schematically and generally a configuration of a prior art reverse rotation control apparatus for a two-cycle engine of a motor vehicle in which a conventional gear box is employed. Referring to FIG. 4, an internal combustion engine (hereinafter referred to simply as the engine) 1 driven in two cycles (i.e., two-cycle engine) is installed on a motor vehicle (not shown). The engine 1 has an output shaft 2 which rotates in one direction as indicated by an arrow, wherein a driving torque generated by the engine 1 is outputted through the medium of a clutch 3 and a gear box 4. At this juncture, it should be mentioned that the gear box 4 is provided with a back gear train for allowing the motor vehicle to be driven backwardly or rearwardly.

Furthermore, a change lever 5 is provided in the gear box 4 for allowing a driver to manually change over gear trains. A rotation sensor 6 for detecting the engine speed (rpm) as well as angular position of a crank shaft (crank angle) of the engine is implemented in the form of an electromagnetic pickup device or the like and provided in association with the output shaft of the engine 1. A rotation signal SG derived from the output of the rotation sensor 6 is inputted to an ignition control unit 10 which may be constituted by a microprocessor or microcomputer.

The ignition control unit 10 is so designed or programmed as to arithmetically determine control timings for the engine 1 for issuing an ignition signal P on the basis of operating state information which includes not only the rotation signal SG mentioned above but also other signals derived from the outputs of other various sensors (not shown).

An ignition coil 11 is realized in the form of a transformer having a primary winding and a secondary winding for generating in response to the ignition signal P a secondary voltage boosted up upon interruption of the primary current, whereby a high voltage for firing is applied to a spark plug 12 of the engine 1. In this conjunction, it is to be noted that the engine 1 is subjected to rotation control in a predetermined direction by controlling the ignition timing on the basis of the rotation signal SG.

In the two-cycle engine of a motor vehicle equipped with the conventional reverse rotation control apparatus as shown in FIG. 4, the rotation output or output torque of the engine 1 can be reduced as desired by means of the gear box 4 while the driving direction of the motor vehicle can be changed over between the forward direction and the rearward or backward direction with the aid of the back gear train.

However, with the arrangement shown in FIG. 4, difficulty will be encountered in assuring a space around the engine 1 for affording accommodation and installation of the gear box 4. In particular, in the case of the snowmobile and the all-terrain vehicle mentioned previously, difficulty is encountered in making available an engine room for accommodating therein the engine 1 itself. Consequently, additional provision of the gear box 4 will incur remarkable increase in the manufacturing cost of these types of motor vehicles.

At this juncture, it is noted that the two-cycle engine has a feature that the crank shaft can be rotated in any one of the forward direction or the reverse direction by selectively controlling the ignition timing, differing from the four-cycle engine.

In actuality, a reverse rotation control apparatus for a two-cycle engine has been realized by making use of the above-mentioned feature. By way of example, there is disclosed in U.S. Pat. No. 5,036,802 issued in 1997 such an reverse rotation control apparatus for a two-cycle engine of a motor vehicle which makes it possible to drive the motor vehicle either in the forward direction or in the backward direction through the reverse rotation control of the engine 1 by using a centrifugal-type automatic transmission (not shown) without resorting to the use of the gear box 4.

In the case of the reverse rotation control apparatus disclosed in the U.S. Patent specification cited just above, when a driving direction of a motor vehicle equipped with a two-cycle engine is to be reversed, a driver manipulates a rotation reversing lever in a normal rotation state of the engine 1 (corresponding to e.g. forward traveling of the motor vehicle). Then, the ignition control unit 10 lowers the rotation speed (rpm) of the engine 1 by forcibly causing misfire to take place in the engine 1. When the engine rotation speed has thus been lowered to a predetermined rotation speed (e.g. 500 rpm) which is suited for the reverse rotation control (i.e., control for reversing the rotating direction of the engine), the ignition timing at which the ignition signal P is applied is caused to advance excessively beyond a normal advance control position (lying within a range of 5° to 30° before the top dead center TDC in terms of crank angle, i.e., BTDC 5° to 30°). With the excessive advance control for the ignition timing described above, the ignition timing is set, for example, at BTDC 40° (i.e., at the crank angle of 40° before the top dead center or BTDC 40°), for thereby allowing the engine 1 to transit from the normal rotation state (corresponding to e.g. forward running of the motor vehicle) to the reverse rotation state (corresponding to e.g. rearward traveling direction of the motor vehicle).

Thereafter, the ignition control unit 10 regards the reverse rotation direction as the normal rotation direction and the ignition signal P is generated at the ordinary ignition timing for sustaining continuously the reverse rotation state of the engine 1. Thus, the motor vehicle can be driven backwardly or in the reverse direction. Parenthetically, when the engine 1 is to be restored from the reverse rotation state to the normal rotation state, the control process similar to that described above is carried out by regarding the current rotating direction of the engine (i.e., the reverse rotation) as the normal rotating direction.

With the reverse rotation control apparatus described above, manufacturing cost of the motor vehicle can certainly be reduced significantly because the gear box 4 can be spared. However, because the engine rotation number or engine speed (rpm) is lowered to a predetermined rotation number at which the rotation of the engine 1 can be reversed by resorting to the misfire control technique described above, unburnt gas is discharged from the engine 1 during the misfire control process, giving rise to a problem.

Furthermore, during the misfire control process, deposition of fuel components on a discharge electrode of the spark plug 12 is likely to occur, as a result of which ignition performance of the engine 1 may possibly be degraded at a succeeding ignition timing, to a disadvantage.

As can be understood from the foregoing, the reverse rotation control apparatus for the two-cycle engine for a motor vehicle suffers a problem that when the gear box 4 such as shown in FIG. 4 is employed, there arises the necessity for ensuring a space for installation of the gear box 4 around the engine 1, which will of course lead to increasing of the cost.

On the other hand, the system for the reverse rotation control of the engine 1 in which the engine rotation number is once lowered by resorting to the misfire control process and then advances in excess the ignition timing, as is disclosed in U.S. Pat. No. 5,036,802, suffers such problem that degradation may be brought about in the exhaust gas composition as well as in the ignition performance of the engine.

SUMMARY OF THE INVENTION

In the light of the state of the art described above, it is an object of the present invention to provide a reverse rotation control apparatus for a two-cycle engine of a motor vehicle which apparatus can be implemented inexpensively by rendering it unnecessary to use the gear box while protecting the exhaust gas composition and the ignition performance of the engine against any appreciable degradation.

In view of the above and other objects which will become apparent as the description proceeds, there is provided according to a general aspect of the present invention a reverse rotation control apparatus for a two-cycle engine mounted on a motor vehicle and driven in two cycles, which apparatus includes a variety of sensors for generating a variety of information signals in correspondence to engine operating states, and an ignition control unit for generating an ignition signal for the engine on the basis of the variety of information signals. The variety of sensors include at least a rotation sensor for generating a rotation signal corresponding to rotation of the engine and a reverse rotation switch for generating a reverse rotation command signal for changing over of engine rotation to a reverse rotation, wherein the ignition control unit includes an ignition timing retard control means for causing ignition timing of the engine to retard beyond a top dead center upon inputting of the reverse rotation command signal, an engine rotation number decision means for deciding whether or not rotation number of the engine is lowered to a predetermined rotation number suited for effectuating reverse rotation control, and an excessively advanced ignition signal generating means for outputting only once an ignition signal advanced excessively relative to a normal advanced ignition timing when the engine rotation number is lowered to the predetermined rotation number mentioned above which is suited for effectuating the reverse rotation control, wherein the predetermined rotation number is set at a value smaller than an idling rotation number of the engine.

By virtue of the arrangement described above, there can be realized inexpensively a two-cycle engine system equipped with the reverse rotation control apparatus without need for installation of the gear box while preventing or suppressing deterioration of the exhaust gas composition and the ignition performance of the engine system.

In a preferred mode for carrying out the invention, the ignition control unit may include a reverse rotation condition decision means for making decision upon inputting of the reverse rotation command signal as to whether or not the engine operating state satisfies the reverse rotation enabling conditions, wherein the ignition timing retard control means is validated only when the reverse rotation enabling conditions are satisfied.

With the arrangement described above, enhanced maneuverability of the motor vehicle can be ensured, to another advantage.

In another preferred mode for carrying out the invention, a brake switch for generating a brake signal upon braking operation and an idle switch for generating an idle signal when an acceleration pedal is released are provided, wherein the reverse rotation enabling condition decision means may be so designed as to determine that the reverse rotation enabling conditions are met when the engine rotation number indicates an engine rotation number corresponding to an idling rotation number and when both of the brake signal and the idle signal are inputted.

With the arrangement described above, maneuverability of the motor vehicle can equally be enhanced.

In yet another preferred mode for carrying out the invention, the ignition timing retard control means may be so designed or programmed as to make the ignition timing retard by a crank angle of 0° to 30° from the top dead center.

Owing to the arrangement described above, the rotation speed (rpm) of the two-cycle engine can be lowered with high reliability.

In still another preferred mode for carrying out the invention, the ignition control unit may be so implemented as to include a normal ignition means for outputting a normal ignition signal in succession to an excessively advanced ignition signal generated by the excessively advanced ignition signal generating means, a reverse rotation decision means for deciding whether or not the engine is in a reverse rotation state at the time point when the normal ignition signal is outputted, and a reverse rotation repeating means for executing repetitively reverse rotation control processing for the engine until the reverse rotation state is validated.

By virtue of the arrangement described above, useless repetitive execution of the reverse rotation control can be avoided.

In a further preferred mode for carrying out the invention, the reverse rotation repeating means may include a counter means for counting a number of times the reverse rotation control processing is repeated, wherein the reverse rotation control processing is terminated at a time point when the repeating number has attained a predetermined rotation number.

Owing to the arrangement described above, repetitive execution of the reverse rotation control in vain can be avoided.

In yet further preferred mode for carrying out the invention, the reverse rotation control apparatus mentioned above may further include a normal rotation indicating lamp and a reverse rotation indicating lamp, wherein both the lamps are driven under the control of the ignition control unit such that the normal rotation indicating lamp is energized only when the engine is rotating in the normal direction, while the reverse rotation indicating lamp is lit only when the engine is rotating in the reverse direction.

With the arrangement described above, visibly recognizable information as to the current state of the motor vehicle can be made available for the driver of the motor vehicle.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
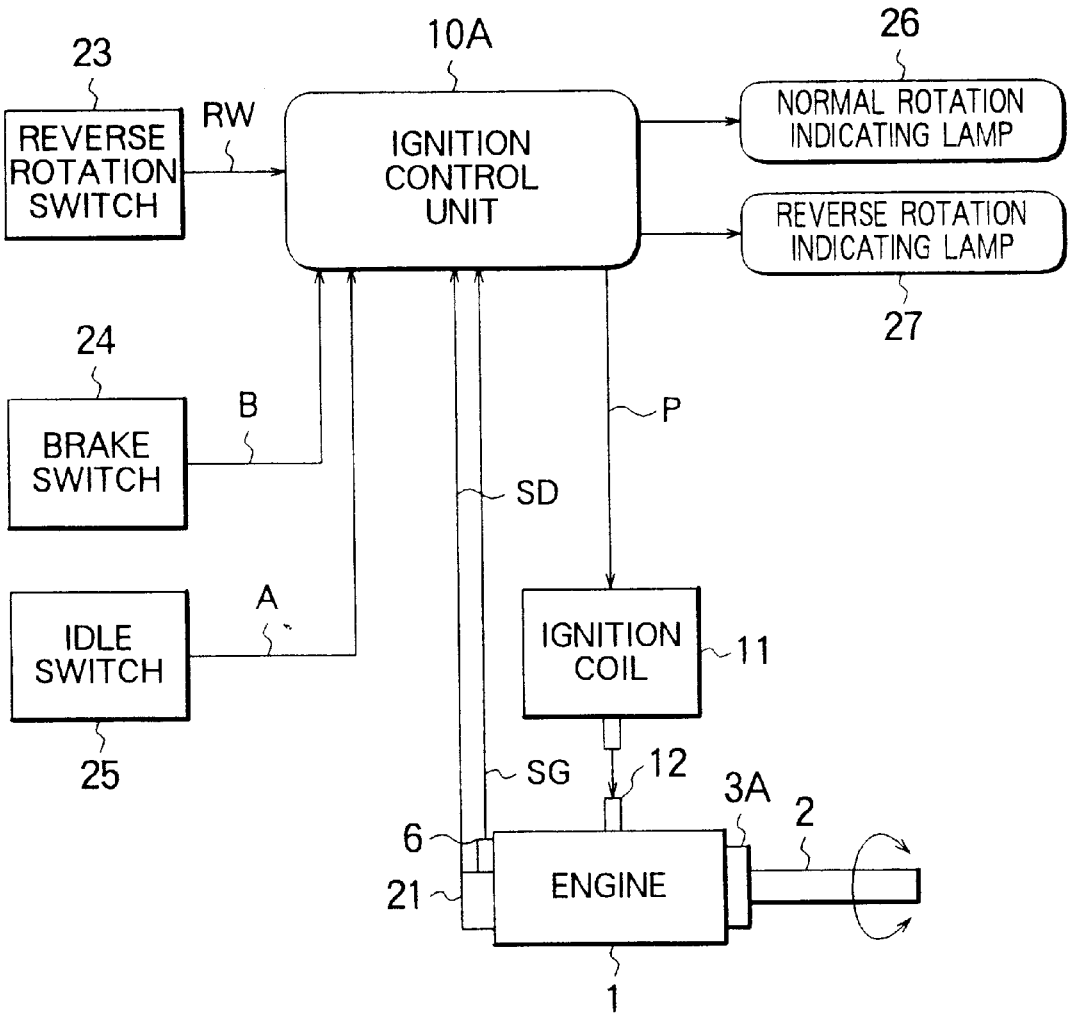
FIG. 1 is a block diagram showing generally an arrangement of a reverse rotation control apparatus for a two-cycle engine of a motor vehicle according to an embodiment of the present invention.

The present invention will be described in detail in conjunction with what is presently considered as preferred or typical embodiments thereof by reference to the drawings. In the following description, like reference characters designate like or corresponding parts throughout the several views.

Now, description will be made of a reverse control apparatus according to an embodiment of the present invention by reference to FIG. 1. FIG. 1 is a functional block diagram showing generally an arrangement of the reverse rotation control apparatus and a two-cycle engine system according to the first embodiment of the invention. In the figure, components like as or equivalent to those described hereinbefore by reference to FIG. 4 are designated by like reference characters and repeated description in detail of these components is omitted.

Figure 4:
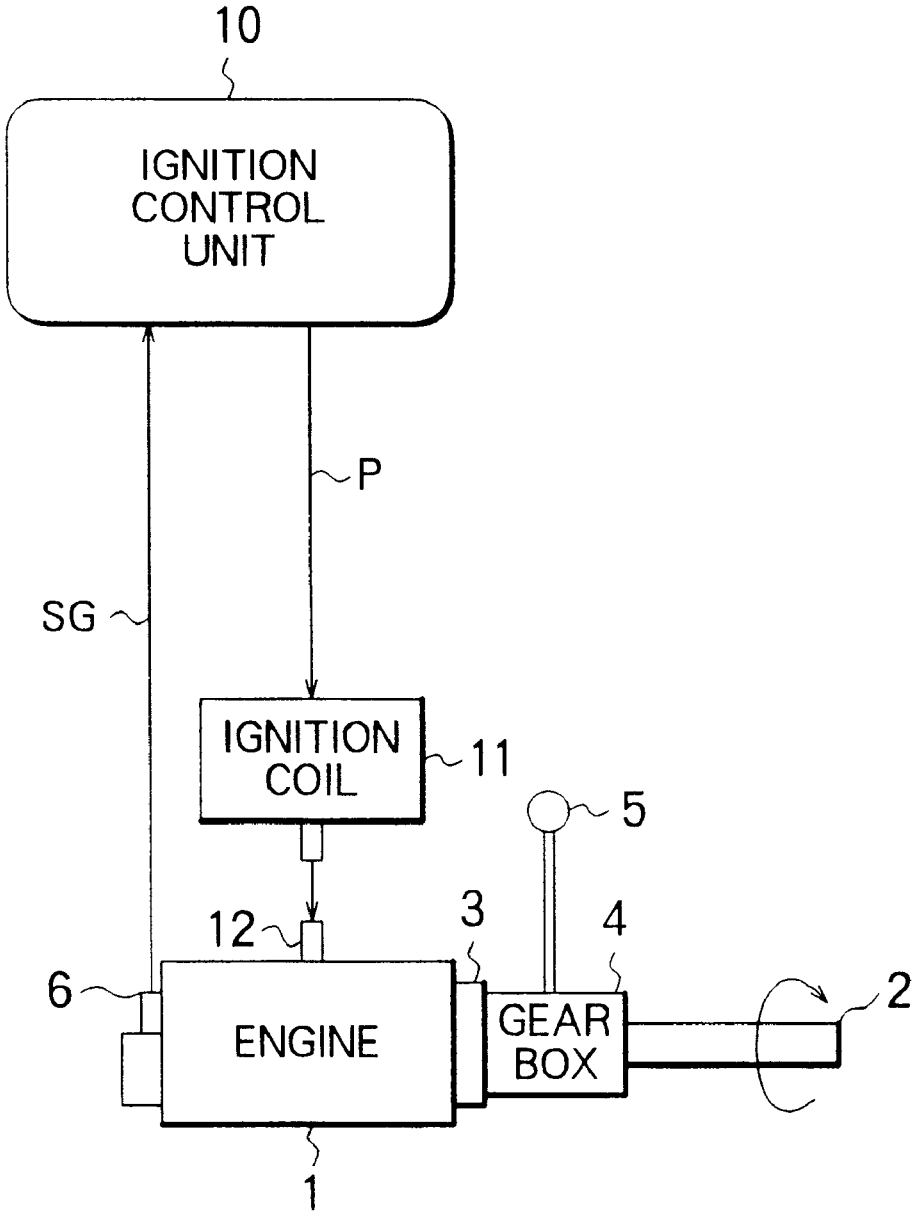
FIG. 4 is a block diagram showing schematically and generally a configuration of a prior art reverse rotation control apparatus for a two-cycle engine of a motor vehicle.

Referring to FIG. 1, an ignition control unit 10A substantially corresponds to the ignition control unit 10 described hereinbefore by reference to FIG. 4 with exception that a control operation executing program differs in some respects.

Further, a centrifugal automatic transmission 3A corresponds to the clutch 3 described hereinbefore and implemented in the form of a conventional V-belt transmission. The engine 1 has an output shaft 2 which is adapted to rotate exchangeably in either a forward direction or a reverse direction, as is indicated by a double arrow.

A rotating direction sensor 21 is provided in association with a rotatable shaft of the engine 1 for generating a rotating direction signal SD indicating the rotating direction of the engine 1. Further provided is a reverse rotation switch 23 which may be constituted by a push button switch for generating a reverse rotation command signal RW indicating a reverse rotation command in response to manipulation of the push button switch by an operator or driver.

A brake switch 24 is so arranged as to output a brake signal B in response to brake applying operation performed by the driver. On the other hand, an idle switch 25 is arranged to output an idle signal A indicating an idling operation state of the engine 1 (the state in which an acceleration pedal is released) in response to acceleration pedal releasing operation performed by the driver (i.e., operation for closing fully a throttle valve disposed within an intake pipe of the engine).

The rotating direction sensor 21, the reverse rotation switch 23, the brake switch 24 and the idle switch 25 constitute together with the rotation sensor 6 a set of the so-called various sensors which generate or output various information signals corresponding to the operating states of the engine 1. The rotating direction signal SD, the reverse rotation command signal RW, the brake signal B and the idle signal A outputted from the so-called various sensors are supplied as the operating state information to the ignition control unit 10A together with the rotation signal SG outputted from the rotation sensor 6.

Parenthetically, it goes without saying that a starter switch for starting the engine 1 is provided although it is not shown in FIG. 1 and thus a start signal is also inputted to the ignition control unit 10A upon starting of the engine 1.

In the ignition control unit 10A, the rotation signal SG, the brake signal B, the idle signal A and the start signal are utilized as the information indicative of the conditions for starting the control for reversing the rotation (referred to also as the reverse rotation control) of the engine 1.

More specifically, since the reverse rotation control is preferred not to be executed in the state in which the motor vehicle is cruising (running steadily), the ignition control unit 10A is so designed or programmed that the reverse rotation control can not be executed even when the reverse rotation switch 23 is closed with the reverse rotation command signal RW being inputted to the ignition control unit 10A so far as the conditions for stopping the engine 1 (hereinafter also referred to also as the engine stopping conditions) are not satisfied.

The ignition control unit 10A includes a reverse rotation enabling condition decision means for making decision upon inputting of the reverse rotation command signal RW as to whether or not the engine operating state satisfies the conditions for enabling the reverse rotation, a retarding control means for making the ignition timing of the engine 1 retard beyond the top dead center TDC when the conditions for enabling the reverse rotation are satisfied, a rotation number decision means for deciding whether or not the engine rotation number Re is lowered to a predetermined engine rotation number ReW suited for the reverse rotation control, and an excessively advanced ignition signal generating means for outputting only once the ignition signal P advanced at a time point excessively relative to a normal or ordinary advanced ignition timing.

Further, the ignition control unit 10A includes a normal ignition means for outputting an ordinary or normal ignition signal P in succession to the excessively advanced ignition signal P generated by the excessively advanced ignition signal generating means, a reverse rotation decision means for deciding whether or not the engine 1 is in the reverse rotation state at the time point when the normal ignition signal P is outputted, and a reverse rotation control repeating means for executing repetitively reverse rotation control processing for the engine 1 until the reverse rotation state has been decided.

The reverse rotation enabling condition decision means incorporated in the ignition control unit 10A makes decision that the conditions enabling the reverse rotation of the engine are satisfied to thereby validate the retarding control means only when the reverse rotation enabling conditions are met in the state in which the engine rotation number Re indicates the engine rotation number corresponding to the idling rotation number and in which both the brake signal B and the idle signal A are inputted.

The retarding control means makes the ignition timing retard by the crank angle of ca. 0° to 30° from the top dead center TDC of the engine 1.

Further, the reverse rotation repeating means includes a counter means for counting a number CN of times the reverse rotation control processing is repeated for terminating the reverse rotation control processing at a time point when the repeating number CN has reached a predetermined rotation number N.

At this junction, it should be mentioned that the predetermined engine rotation number ReW suited for triggering the reverse rotation is set to a rotation number (e.g. in a range of 600 to 400 rpm) which is lower than the idling rotation number of the engine 1.

There are provided a normal rotation indicating lamp 26 and a reverse rotation indicating lamp 27 which are driven under the control of the ignition control unit 10A for indicating to the driver the direction in which the engine 1 is rotating currently (i.e., normal rotation or reverse rotation) and hence the traveling direction of the motor vehicle (i.e., forward or rearward). The normal rotation indicating lamp 26 is energized only when the engine is rotating in the normal direction (usually corresponding to the forward traveling direction of the motor vehicle), while the reverse rotation indicating lamp 27 is lit only when the engine is rotating in the reverse direction.

Next, referring to FIGS. 2 and 3, operation of the reverse rotation control apparatus according to the instant embodiment of the invention will be described.

As elucidated hereinbefore, rotation of the two-cycle engine 1 can be reversed by controlling the ignition timing.

More specifically, the engine rotation number Re is lowered to the predetermined engine rotation number ReW (ca. 500 rpm) at which the output torque is relatively low, and ignition or firing is performed at a crank angle position advanced relative to the normal ignition timing during displacement of the piston of the engine 1 toward the top dead center TDC, as a result of which a repulsing force is produced due to the explosion of combustible mixture within the engine cylinder. Thus, the reverse rotation of the engine is triggered. Once the reverse rotation has been realized, the normal or ordinary ignition timing control is resumed for sustaining continuously the reverse rotation state as desired by the driver.

In that case, as the basic operations, the ignition control unit 10A performs detection of the crank angle (i.e., angular position of the crank shaft) position and the rotation number Re of the engine 1 on the basis of the rotation signal SG as well as the rotating direction of the engine 1 from the rotating direction signal SD, to thereby control the ignition timing for the normal rotation operation mode or for the reverse rotation operation mode.

Further, as the intrinsic operation, the ignition control unit 10A executes the ignition timing retard control for lowering the engine rotation number Re in response to the manipulation of the reverse rotation switch 23 only when the conditions enabling the reverse rotation are satisfied in view of the conditions for initiating the reverse rotation control.

Figure 2:
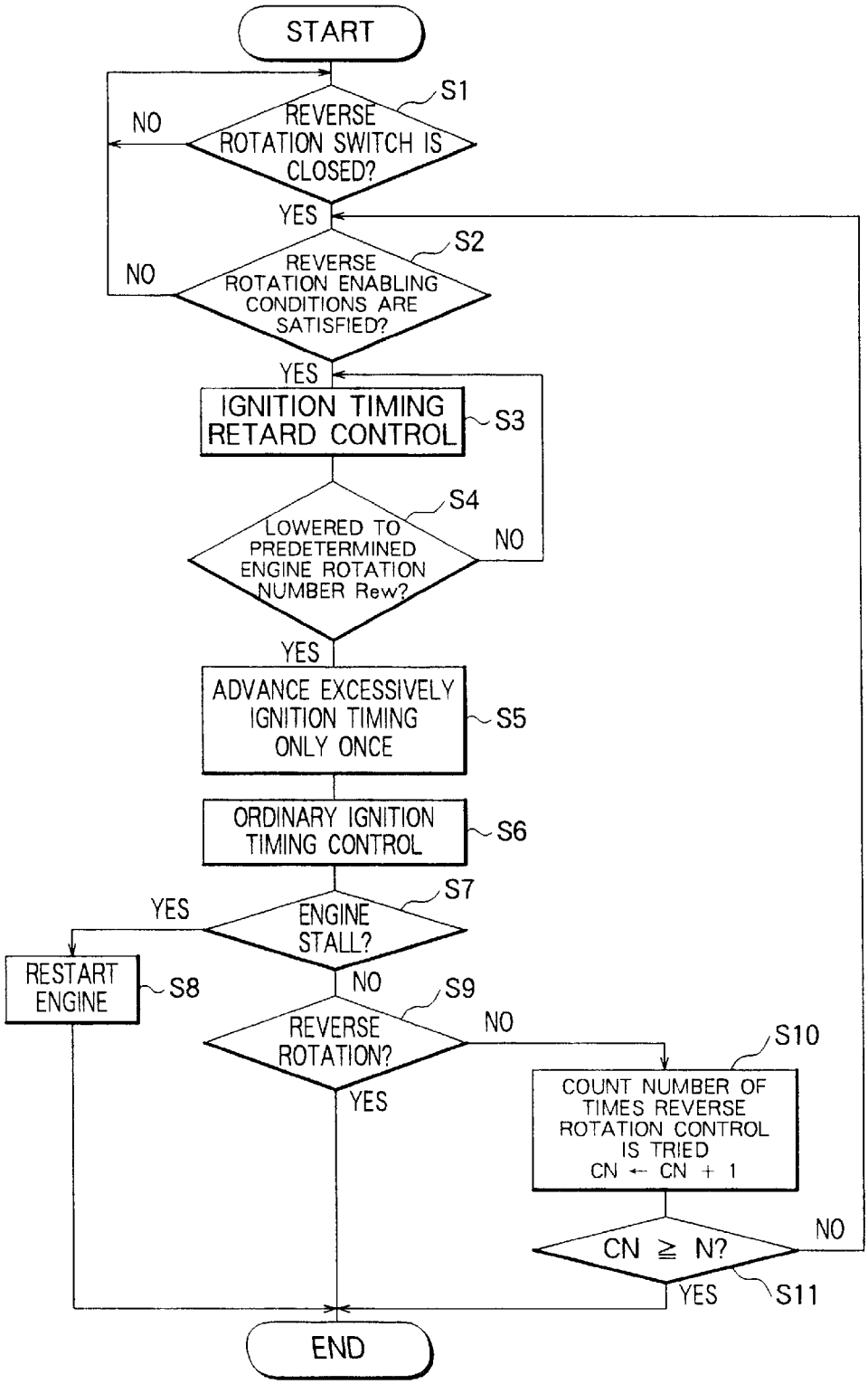
FIG. 2 is a flow chart illustrating a reverse rotation control procedure executed by an ignition control unit incorporated in the apparatus shown in FIG. 1.

FIG. 2 is a flow chart showing a reverse rotation control procedure or processing executed by the ignition control unit 10A. More specifically, this flow chart illustrates a processing procedure involved for changing over the engine rotation from the normal rotation mode to the reverse rotation mode. In this conjunction, it should be mentioned that restoration of the engine 1 from the reverse rotation mode to the normal rotation mode can equally be realized by resorting to the substantially same procedure as well.

Figure 3:
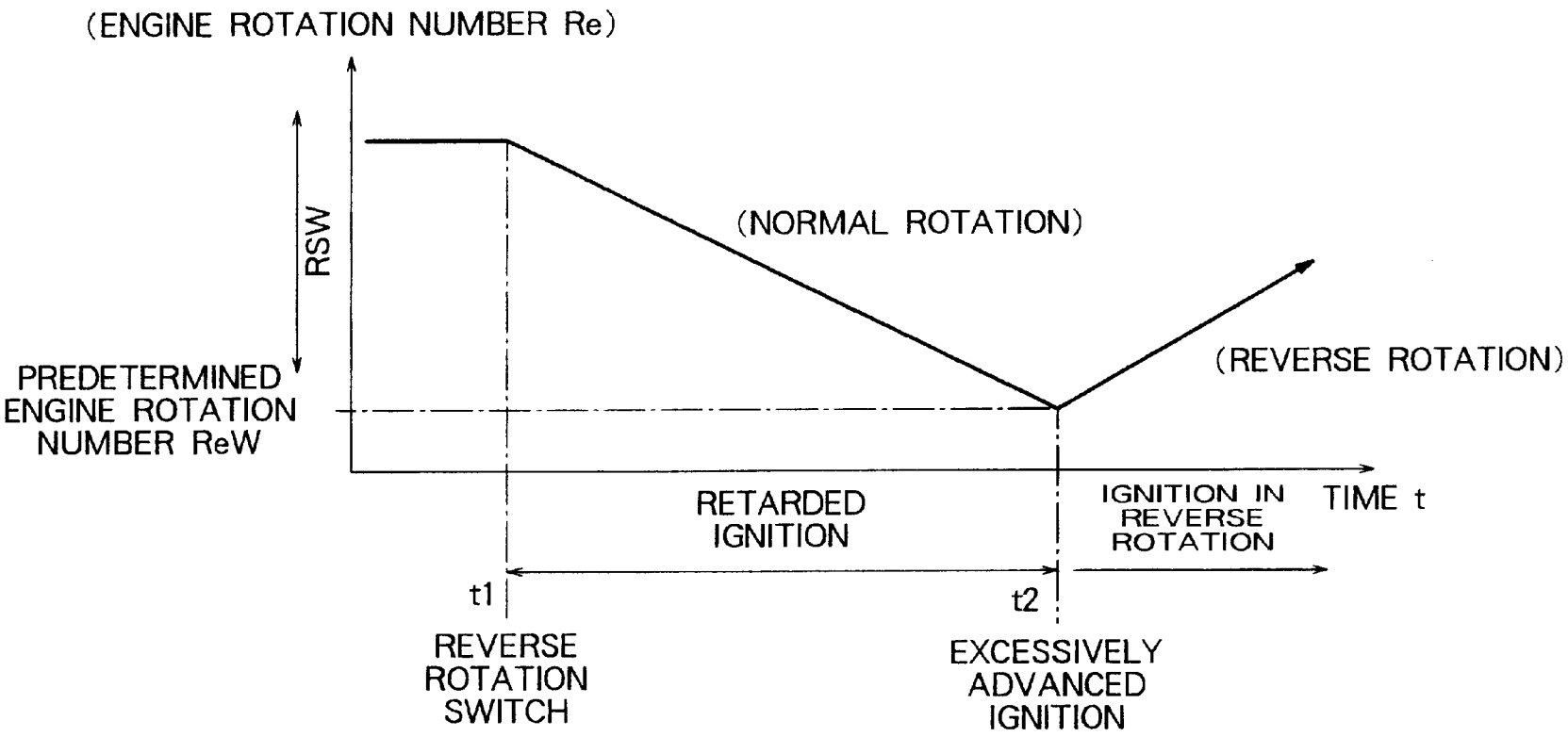
FIG. 3 is a timing chart for illustrating change of an engine rotation number in the course of a rotation reverse control processing.

Further, FIG. 3 is a timing chart illustrating change of the engine rotation number Re taking place in the course of the rotation reversing processing.

Upon starting of the engine operation, the engine 1 is rotated in the forward direction (also referred to as the normal direction) under the control of the ignition control unit 10A. Subsequently, the normal or ordinal ignition control is performed in conformance with the prevailing engine operating state by arithmetically determining the ignition timing.

Now, let's assume that the driver manipulates the reverse rotation switch 23. Then, the reverse rotation command signal RW is inputted to the ignition control unit 10A.

Now, referring to FIG. 2, the ignition control unit 10A monitors constantly whether the reverse rotation switch 23 is turned on (closed) or not (step S1). The reverse rotation command signal RW is detected within a detectable range RSW of the engine rotation number Re (see FIG. 3).

When the reverse rotation command signal RW is inputted to the ignition control unit 10A, it is then decided in the step S1 that the reverse rotation switch 23 is closed (i.e., the output of the decision step S1 is affirmative or "YES"). Subsequently, in a succeeding step S2, decision is made as to whether or not the engine operating state at this time point satisfies the reverse rotation enabling conditions.

As the conditions for enabling or validating the reverse rotation of the engine 1, there may be mentioned such conditions that the engine rotation number Re is lower than that in the ordinary running state (e.g. lower than 2000 rpm inclusive), both the idle signal A and the brake signal B are inputted, the time lapse from the start of the engine 1 amounts to at least 2 seconds, and so forth.

When it is decided in the step S2 that the reverse rotation enabling conditions are not met (i.e., when the decision step S2 results in negation or "NO"), the reverse rotation command signal RW being currently inputted is neglected, whereupon the processing resumes the step S1.

To this end, the ignition control unit 10A may be so programmed as not to start the reverse rotation control unless any one of the following conditions is met, i.e., the conditions that the engine rotation number Re determined on the basis of the rotation signal SG lies within a predetermined range of the idling rotation number (800 rpm to 2000 rpm), the brake signal B is inputted by way of the brake switch 24 due to depression of a brake pedal by the driver and the idle signal A is inputted by way of the idle switch 25 with the acceleration pedal being released. Unless any one of these conditions is satisfied, the reverse rotation control is inhibited from being started.

In this manner, the reverse rotation control is inhibited unless stability can not be ensured in driving the motor vehicle, whereby maneuverability of the motor vehicle is projected against degradation.

On the other hand, when decision is made in the step S2 that the reverse rotation enabling condition or conditions are met (i.e., when the step S2 results in "YES"), the ignition control unit 10A puts into operation the reverse rotation control.

By way of example, when the engine rotation number Re in the normal rotation mode (forward driving mode of the motor vehicle) is 1200 rpm after lapse of 2 seconds or more from the engine start (corresponding to the idle state) and when the idle signal A and the brake signal B are inputted, the reverse rotation control is started in response to the input of the reverse rotation command signal RW.

At first, the ignition control unit 10A outputs the ignition signal P with sufficient retard of the ignition timing for executing the ignition timing retard control (step S3). More specifically, the ignition control unit 10A sets the ignition timing of the engine 1 to a retarded crank angle position (with a range of crank angle 0° to 30° after the top dead center TDC, hereinafter represented by ATDC 0° to 30° or so) at which the engine rotation number Re can be lowered low from the current advanced state (e.g. crank angle position of 5° to 30° before the top dead center TDC, hereinafter also represented by BTDC 5° to 30°).

By setting the ignition timing within the range of ATDC 0° to 30° in terms of the crank angle in the idling state in this manner, the output torque becomes low, being accompanied with rapid decreasing of the engine rotation number Re in the case of the two-cycle engine.

So long as the ignition timing retard control (step S3) is being effected, the engine rotation number Re continues to lower, as can be seen in FIG. 3.

In that case, the ignition control unit 10A monitors constantly the engine rotation number Re for making decision whether or not the engine rotation number Re has lowered to the predetermined engine rotation number ReW (step S4) while performing the ignition timing retard control until the engine rotation number Re has been lowered to the predetermined engine rotation number ReW (e.g. 500±100 rpm) in the step S3.

When the output torque of the crank shaft of the engine 1 becomes sufficiently low through the ignition timing retard control (step S3), then decision is made in a step S4 that the engine rotation number Re has lowered to the predetermined engine rotation number ReW (e.g. 600 to 400 rpm). In other words, output of the decision step S4 is affirmative "YES".

Thus, the ignition control unit 10A generates only once the ignition signal P set at an excessively advanced crank angle (within a range of BTDC 30° to BTDC 60°) relative to the ordinary advanced ignition timing (which lies usually within a range of BTDC 5° to BTDC 30°) during the piston stroke toward the top dead center TDC (step S5).

Being triggered by this excessively advanced ignition timing (step S5), the engine 1 starts the reverse rotation.

In that case, during a period from a time point t1 to a time point t2 before the ignition at the excessively advanced crank angle for realizing the reverse rotation of the engine 1 (see FIG. 3), the ignition timing retard control is carried out continuously, whereby the engine rotation number Re is lowered to the predetermined engine rotation number ReW which is optimal for effectuating the reverse rotation of the engine 1. Thus, the reverse rotation starting operation of the engine 1 can be realized with high reliability.

Once the reverse rotation has been started, then the engine control is performed in continuation through the ordinary ignition timing control by regarding the reverse rotation mode as the normal rotation mode (step S6). Consequently, the engine rotation number Re of the engine 1 increases also in the reverse rotation mode, as can be seen in FIG. 3.

It should however be mentioned that rotation of the engine 1 can not always be reversed in the step S6. Accordingly, in succession to the step S6, the ignition control unit 10A makes decision as to whether the stall of the engine 1 takes place or not (step S7). When the stall occurs (i.e., when the result of the decision step S7 is "YES"), the engine 1 is restarted in a step S8, whereupon the processing illustrated in FIG. 2 comes to an end.

On the other hand, when it is decided in the step S7 that no engine stall occurs (i.e., when the output of the decision step S7 is "NO"), then a step S9 is executed for deciding whether or not the engine 1 is rotating in the reverse direction by referencing the rotation signal SG (crank angle signal) and the rotating direction signal SD.

When it is decided in the step S9 that the engine is currently rotating in the reverse direction (i.e., when the output of the step S9 is "YES"), the ignition control unit 10A deenergizes the normal rotation indicating lamp 26 while lighting the reverse rotation indicating lamp 27 to inform the driver that the rearward driving of the motor vehicle is now validated, whereupon the processing illustrated in FIG. 2 comes to an end.

On the other hand, when it is decided in the step S6 that the engine 1 is rotating in the normal or forward direction because of failure in reversing the engine rotation (i.e., when the output of the decision step S9 is "NO"), this means that the engine 1 is rotating in the ordinarily normal direction (forward direction). Thus, there arises necessity of executing again the reverse rotation control processing.

In that case, the ignition control unit 10A counts the number of the times the reverse rotation control is tried by incrementing a corresponding counter value CN in a step S10 and makes decision as to whether or not the counter value CN has reached a predetermined value N (e.g. three) in a step S11.

When it is decided in the step S11 that the reverse rotation control processing was repeated a predetermined number of times N and that the counter value CN is equal to or greater than the predetermined value N (i.e., when the output of the step S11 is "YES"), then the processing shown in FIG. 2 is terminated by regarding that attempt for realization of the reverse rotation control ends in vain. In this way, useless repetition of the reverse rotation control validating process is prevented.

As is apparent from the above, when the reverse rotation of the engine can not be realized within the predetermined number (N) of repetitions, the ordinary engine control in the forward driving direction is restored without repeating the attempt for realizing the reverse rotation control in vain, whereon the ignition control unit 10A is reset to the state waiting for the reverse rotation command issued upon actuation of the reverse rotation switch 23.

When the decision in the step S11 results in that CN<N (i.e., when the output of the step S11 is "NO"), the reverse rotation condition decision step S2 is resumed, whereon attempt for enabling or validating the reverse rotation control described above is repeated. The number of times the reverse rotation control processing can be tried may be set to e.g. three times. In this manner, validation of the reverse rotation control is automatically tried with the ignition timing being retarded relative to the ordinary ignition timing.

At this juncture, it should be mentioned that the conditions for enabling the reverse rotation control are checked even in the course of the reverse rotation control so that the reverse rotation control processing can be reset immediately when the conditions for enabling the reverse rotation control are no more satisfied due to releasing of the brake and/or actuation of the acceleration pedal, whereby the ordinary engine control in the forward direction is resumed.

The ignition control unit 10A performs the control for preventing runaway of operation of the centrifugal automatic transmission 3A and validates the ordinary control when the conditions for changing over the reverse rotation to the forward or normal rotation are satisfied. The changeover of the engine operation from the reverse rotation control state (rearward driving of the motor vehicle) to the normal rotation state (forward driving of the motor vehicle) can be realized by executing the control processing procedure illustrated in FIG. 2 by regarding the reverse mode prevailing currently as the normal rotation mode.

By controlling the ignition timing in the retarding direction for validating the reverse rotation control (step S3), the engine rotation number Re can be lowered. The rotation of the engine 1 can be reversed with high reliability by advancing in excess the ignition timing for applying the ignition signal P (step S5) at the time point when the engine rotation number has lowered to the predetermined engine rotation number ReW suited for applying the excessively advanced ignition signal P for enabling the reverse rotation control (step S4).

As is apparent from the foregoing, according to the teachings of the present invention, the reverse rotation of the engine can be realized by employing the inexpensive centrifugal automatic transmission 3A without using the expensive gear box 4 (see FIG. 4), and thus the peripheral space of the engine 1 can be reduced, which means that the whole engine system can be implemented inexpensively in a small size. Besides, maneuverability of the motor vehicle equipped with the engine according to the invention can be effectively enhanced because of possibility of implementing the engine 1 in light weight.

Furthermore, because the engine rotation number Re can be lowered owing to the ignition timing retard control, deterioration of the exhaust gas composition can be prevented since substantially no unburnt gas is discharged. Besides, deposition of fuel on the discharge electrode of the spark plug 12 and the ignition performance of the engine 1 can be protected against deterioration.

Furthermore, by setting the conditions for retarding the ignition timing for enabling the reverse rotation control such as the engine rotation number equivalent to the idling state etc., the reverse rotation control processing can be started only when the reverse rotation enabling conditions are met. Besides, upon failure of the reverse rotation of the engine 1, the reverse rotation control processing is repeated, which contributes to enhancing the reliability in reversing the engine rotation.

Additionally, because the ignition control unit 10A is so arranged as to light the reverse rotation indicating lamp 27 while deenergizing the normal rotation indicating lamp 26 when the engine rotation is reversed, information indicating that the motor vehicle can be traveled rearwardly or backwardly is made available for the driver.

Many modifications and variations of the present invention are possible in the light of the above techniques. It is therefore to be understood that within the scope of the appended claims, the invention may be practiced otherwise than as specifically described.

What is claimed is:

1. A reverse rotation control apparatus for a two-cycle engine mounted on a motor vehicle and driven in two cycles, comprising:

a variety of sensors for generating a variety of information signals in correspondence to engine operating states; and an ignition control unit for generating an ignition signal for said engine on the basis of said variety of information signals, wherein said variety of sensors include at least a rotation sensor for generating a rotation signal corresponding to rotation of said engine and a reverse rotation switch for generating a reverse rotation command signal for changing over of engine rotation to a reverse rotation, and wherein said ignition control unit includes:

ignition timing retard control means for causing ignition timing of said engine to retard beyond a top dead center upon inputting of said reverse rotation command signal;

engine rotation number decision means for deciding whether or not rotation number of said engine is lowered to a predetermined rotation number suited for effectuating reverse rotation control; and excessively advanced ignition signal generating means for outputting only once an ignition signal advanced excessively relative to a normal advanced ignition timing when said engine rotation number is lowered to said predetermined rotation number suited for effectuating the reverse rotation control, wherein said predetermined rotation number is set at a value smaller than an idling rotation number of said engine.

2. A reverse rotation control apparatus for a two-cycle engine of a motor vehicle according to claim 1, wherein said ignition control unit includes:

reverse rotation condition decision means for making decision upon inputting of said reverse rotation command signal as to whether or not said engine operating state satisfies the reverse rotation enabling conditions, and wherein said ignition timing retard control means is validated only when said reverse rotation enabling conditions are satisfied.

3. A reverse rotation control apparatus for a two-cycle engine of a motor vehicle according to claim 2, wherein said various sensors includes:

a brake switch for generating a brake signal upon braking operation; and an idle switch for generating an idle signal when an acceleration pedal is released, and wherein said reverse rotation enabling condition decision means determines that said reverse rotation enabling conditions are met when said engine rotation number indicates an engine rotation number corresponding to an idling rotation number and when both of said brake signal and said idle signal are inputted.

4. A reverse rotation control apparatus for a two-cycle engine of a motor vehicle according to claim 1, wherein said ignition timing retard control means makes the ignition timing retard by a crank angle of 0° to 30° from the top dead center.

5. A reverse rotation control apparatus for a two-cycle engine of a motor vehicle according to claim 1, wherein said ignition control unit includes:

normal ignition means for outputting a normal ignition signal in succession to an excessively advanced ignition signal generated by said excessively advanced ignition signal generating means;

reverse rotation decision means for deciding whether or not said engine is in a reverse rotation state at the time point when said normal ignition signal is outputted; and reverse rotation repeating means for executing repetitively reverse rotation control processing for said engine until said reverse rotation state is validated.

6. A reverse rotation control apparatus for a two-cycle engine of a motor vehicle according to claim 5, wherein said reverse rotation repeating means includes a counter means for counting a number of times said reverse rotation control processing is repeated, wherein said reverse rotation control processing is terminated at a time point when said repeating number has attained a predetermined rotation number.

7. A reverse rotation control apparatus for a two-cycle engine of a motor vehicle according to claim 1, further comprising:

a normal rotation indicating lamp; and a reverse rotation indicating lamp, wherein said both lamps are driven under the control of said ignition control unit such that said normal rotation indicating lamp is energized only when said engine is rotating in the normal direction, while said reverse rotation indicating lamp is lit only when said engine is rotating in the reverse direction.

* * * * *